United States Patent [19]

Hughes et al.

[11] 4,146,064

[45] Mar. 27, 1979

[54] METHOD OF REDUCING THE FLAMMABILITY HAZARD OF HYDROCARBON AEROSOLS

[75] Inventors: John F. Hughes, Southampton; John M. C. Roberts, Camberley, both of England

[73] Assignee: S. C. Johnson & Son, Inc., Racine, Wis.

[21] Appl. No.: 839,953

[22] Filed: Oct. 6, 1977

[30] Foreign Application Priority Data

Oct. 7, 1976 [GB] United Kingdom ..... 41797/76

[51] Int. Cl.[2] ..... B65B 1/04; B65B 31/00

[52] U.S. Cl. ..... 141/3; 53/470; 141/11; 252/305

[58] Field of Search ..... 53/21 R, 36; 141/2–5, 141/9, 11, 18, 20; 252/305; 424/45, 46, 47

[56] References Cited

U.S. PATENT DOCUMENTS

| | | | |
|---|---|---|---|
| 3,568,394 | 3/1971 | Margolis | 141/3 X |
| 3,630,949 | 12/1971 | Brux et al. | 252/305 |

*Primary Examiner*—Richard E. Aegerter
*Assistant Examiner*—Frederick R. Schmidt

[57] ABSTRACT

The danger of fire from leaking aerosol containers is reduced by reducing the charge potential on leaking containers. This is achieved by a filling method in which an effective amount, for example 0.1 to 5% by weight of a charge reducing agent and a non-aqueous product intermediate are mixed, the mixture is filled into the container and the container is then pressurized with a flammable propellant.

4 Claims, No Drawings

METHOD OF REDUCING THE FLAMMABILITY HAZARD OF HYDROCARBON AEROSOLS

This invention relates to a method for reducing the flammability hazard during the manufacturing of hydrocarbon propelled aerosols, and more particularly it concerns a method of reducing the static charge build-up created by leaking cans.

In any manufacturing procedure there are always some small percentage of substandard units. During the pressurizing of aerosol containers, those containers which were substandard will immediately leak upon pressurizing. When fluorocarbons were used as propellants in aerosol containers, the atmosphere in the gassing room of an aerosol manufacturing facility was non-flammable due to the non-flammable nature of fluorocarbon propellant. Therefore, one of the elements necessary to support combusion, i.e., a fuel source, was absent.

As hydrocarbon propellants have been replacing fluorocarbons in the manufacture of a number of products certain hazards which were on little consequence in previous manufacturing of fluorocarbon propelled products have become apparent. The most obvious hazard is the build-up of propellant vapors in the gassing room. When these were non-flammable fluorocarbon vapors, there was no increased flammability hazard. However, the hydrocarbon propellants are quite flammable when mixed with the proper ratio of air and a hazard of fire exists. The mere presence of a combustible atmosphere, however, will not produce a fire unless there is some ignition means such as a flame or spark.

A hitherto unrecognized hazard was the static charge build-up on the surface of a leaking aerosol container. In a non-flammable fluorocarbon atmosphere, the sparks produced were at most a slight nuisance. However, these sparks when combined with a flammable hydrocarbon atmosphere can produce a fire. The static charge problem is primarily a problem with non-aqueous compositions as the aqueous hydrocarbon compositions dissipate any charge build-up and have a low flammability hazard during production. The problem is further aggravated by compositions which include a powdered material such as spot cleaners, antiperspirants, etc.

It has been discovered that by the addition of an effective amount, such as from 0.1 to 5% by weight of the composition, of a charge quenching agent to the composition substantially reduces the charge build-up on the surface of a leaking aerosol container.

The primary object of the present invention is the reduction of flammability hazard during manufacture of hydrocarbon propelled aerosols.

A further object is the reduction of charge potential on the surface of a leaking aerosol container.

A still further object is the reduction of explosion hazard produced by leaking aerosol containers.

Other objects and advantages will become apparent from the following description of the invention.

According to the invention there is provided a method of filling aerosol containers whereby the charge potential on the surface of the container is reduced in the event of a leak which comprises mixing an effective amount of a charge-quenching agent and a non-aqueous product intermediate, filling the mixture in an aerosol container and pressurizing the container with a flammable propellant.

As is noted above, it has been found that static charges accumulate on the surface of a punctured aerosol container. It is thought that these static charges are produced by tribo-charging of the particles of the aerosol compositions as they are exhausting from the container after a rupture. This tribo-charging is most acute when the aerosol product includes powders or suspended solids. Examples of these products are antiperspirant compositions, aerosol spot cleaners, foot sprays, powder fire extinguishers, and the like.

Although it has been known that the dispensing of an aerosol composition through the orifice will produce some charging, this charging does not present any hazard as the user is commonly in contact with both the can and electrical ground so any charge developed is dissipated. However, in a manufacturing situation, the aerosol containers often are electrically insulated so that a potentially hazardous charge build-up can occur if the container ruptures frequently followed by a spark discharge. In a filling procedure, a certain percentage of containers will rupture and the common practice previously was to toss the leaking container into a bin. While the can is in the air, it is electrically insulated and as it approaches the other cans in the bin there is sufficient potential difference so that a spark of sufficient intensity can be formed which can create a fire or explosion hazard. Although this problem may be alleviated by changing the manufacturing techniques, it would be preferred if a method of reducing the charge formation could be developed.

As the tribo or contact charging requires the contact of at least two different particles which do not readily conduct electricity, it has been discovered that the incorporation of an effective amount of a charge quenching agent into the aerosol composition itself provides sufficient charge quenching so that the hazard of combustive charge accumulation is substantially reduced. The choice of a particular charge quenching agent will depend on the product to which it is to be added. Parameters which must be considered are changes in corrosion characteristics of the composition, viscosity increases or decreases, change in effectiveness of the composition, etc. Although it is difficult to list all materials which will act as charge quenching agents, the following are representative: substituted imidazoline, i.e., Amine O; quaternary ammonium chlorides; acetates and phosphates, i.e., Arquads; fatty acid amines; ethoxylated amines; ethoxylated diamines, i.e., Duomeens; and powders which will accumulate a charge opposite the charge produced by the composition.

The charge quenching or antistatic agent is added to the compositions in an effective amount to reduce the charge accumulation. Generally, this is from 0.1 to 5% by weight of the composition in the container, and preferably from 0.5 to 2% by weight.

The quenching or antistatic agent is added to the non-pressurized composition intermediate by suitable mixing which includes methods capable of producing high shear and/or efficient dispersion, such as ultrasonic homogenizers, high speed mixers, and the like. The particular method of mixing may, for certain compositions, not be particularly critical but could be critical for other compositions. The charge quenching agent must be efficiently and completely dispersed in the non-pressurized intermediate.

After the quenching agent has been added to the intermediate, this composition is then filled in aerosol containers and pressurized in a conventional manner, i.e., impact filling, undercap filling, and the like.

In order to determine the hazard of charge accumulation, the aerosol container may be tested, before manufacture, in the following manner: (1) a sample can is prepared using the intermediate to be packaged and pressurized using laboratory equipment; (2) the can is electrically insulated and connected to an electrostatic volt meter; (3) the can is punctured to give a typical rupture discharge rate of 3 to 30 seconds and (4) the time to reach the combustive charge potential, which is 4 Kv for butane, the maximum Kv, and the polarity of charge are recorded. By testing in this manner before a batch is run in the manufacturing facility, the potential for hazardous charge accumulation will be known.

The process of the present invention will now be illustrated by the following examples.

EXAMPLE 1 and COMPARATIVE EXAMPLE 1

Six aerosol containers were filled with the following formulation:

| | % by weight |
|---|---|
| Isopropyl Myristate | 12.0 |
| Aluminum Chlorhydroxide | 7.0 |
| Fumed Silica | 0.5 |
| Perfume | 0.5 |
| Butane | 80.0 |
| | 100.0 |

Three of the containers were tested as above (Comparative Example 1, Runs A, B, C) while the other three (Example 1, Runs A, B, C) also included 0.1% by weight of coconut oil fatty acid amide. This amide was added to the intermediate, i.e., the composition minus the butane and mixed in an ultrasonic homogenizer at 500 psig. These samples were connected to a volt meter, punctured so the contents would discharge over about 20 seconds, and tested for time to 4 Kv, maximum Kv, and time to maximum Kv. The results are shown in Table I.

TABLE I

| Example/Run | Time to 4 Kv (Sec.) | Max. Kv | Time to Max. Kv (Sec.) |
|---|---|---|---|
| Comp. Ex. 1/A | 1 | 10 | 8 |
| Comp. Ex. 1/B | 3 | 10 | 7 |
| Comp. Ex. 1/C | 2 | 10 | 8 |
| Example 1/A | N.R.* | 1 | 20 |
| Example 1/B | 19 | 4.5 | 21 |
| Example 1/C | N.R.* | 1.5 | 19.5 |

*N.R. = 4 Kv never reached therefore no possibility of incendiary spark.

What is claim is:

1. A method of filling aerosol containers whereby the charge potential on the surface of the container is reduced in the event of a leak, which comprises mixing an effective amount of a charge-quenching agent to quench a static charge and a non-aqueous product intermediate, said intermediate containing a suspended solid, filling the mixture in an aerosol container and pressurizing the container with a flammable propellant wherein the charge quenching agent is selected from the group consisting of quaternary ammonium compounds, substituted imidazolines, fatty acid amines, ethoxylated amines, ethoxylated diamines and mixtures thereof.

2. The method of claim 1 wherein from 0.1 to 5% by weight of a charge-quenching agent is mixed with the intermediate.

3. The method of claim 2 wherein from 0.5 to 2% by weight of the charge-quenching agent is mixed with the intermediate.

4. The method of claim 1 wherein the charge-quenching agent is a coconut oil fatty acid amide.

* * * * *

Disclaimer and Dedication 4,146,064.—*John Farrell Hughes*, Southampton, and *John Michael Charles Roberts*, Camberley, England. METHOD OF REDUCING THE FLAMMABILITY HAZARD OF HYDROCARBON AEROSOLS. Patent dated Mar. 27, 1979. Disclaimer and dedication filed May 23, 1979, by the assignee, *S. C. Johnson & Son, Inc.*

Hereby disclaims and dedicates the entire term of said patent to the Public.

[*Official Gazette August 21, 1979.*]